US007174574B2

(12) United States Patent
Fontes

(10) Patent No.: US 7,174,574 B2
(45) Date of Patent: Feb. 13, 2007

(54) GARMENT WITH IMPROVED FLY CLOSURE

(75) Inventor: Steven Fontes, Newport Beach, CA (US)

(73) Assignee: Quiksilver, Inc., Huntington Beach, CA (US)

( * ) Notice: Subject to any disclaimer, the term of this patent is extended or adjusted under 35 U.S.C. 154(b) by 0 days.

(21) Appl. No.: 10/865,072

(22) Filed: Jun. 10, 2004

(65) Prior Publication Data

US 2005/0273907 A1 Dec. 15, 2005

(51) Int. Cl.
*A41D 1/08* (2006.01)
*A41D 13/012* (2006.01)

(52) U.S. Cl. ..... 2/235; 2/67; 2/228; 2/227

(58) Field of Classification Search ..... 2/67, 2/69, 227, 228, 220, 221, 234, 235, 238, 2/218, 219, 405, 215–217, 81, 82; 450/132, 450/142

See application file for complete search history.

(56) References Cited

U.S. PATENT DOCUMENTS 3,771,169 A * 11/1973 Edmund ..... 2/2.17
6,199,215 B1 3/2001 Biggerstaff ..... 2/234

OTHER PUBLICATIONS

Overton's Catalog, p. 268; 1/2204—Gladiator Neoprene Shorts.*

* cited by examiner

*Primary Examiner*—Gloria M. Hale
(74) *Attorney, Agent, or Firm*—Snell & Wilmer LLP

(57) ABSTRACT

A neoprene fly closure which provides for minimization of bulk through the fly area of a pair of board shorts, which further provides for a more comfortable pair of shorts when worn surfing. The use of a neoprene gore eliminates bulky seams in the fly area, allowing a user to pull shorts on and off and also providing for a privacy shield should the fly area become open.

12 Claims, 2 Drawing Sheets

GARMENT WITH IMPROVED FLY CLOSURE

FIELD OF THE INVENTION

The inventions described below relate to the field of garments and, more particularly, to a garment fly that maintains a neat, flat appearance through the fly when closed.

BACKGROUND OF THE INVENTIONS

It is common for men and women to wear board shorts when engaging in surfing, swimming, or similar activities. It is desirable to avoid bulkiness in the fly area, especially when a person is lying on their stomach on a hard surfboard. Fabric seams in particular add to the bulkiness. Biggerstaff, Fly Closure for Garment, U.S. Pat. No. 6,199,215 (Mar. 13, 2001) describes a fly closure comprising a shield seamed to the right and left panel of the shorts. The shield further comprises a front flap and a back flap seamed together. However, the bottom and top edges of the front and back flaps are folded over and finished with a seam to avoid fraying of the fabric. These seams, though offset to a certain extent, still create bulkiness in the front area of the shorts.

SUMMARY

The fly closure described below provides for minimization of bulk through the fly area of a pair of board shorts, which further provides for a more comfortable pair of shorts when worn surfing. The use of a neoprene gore eliminates bulky seams in the fly area, allowing a user to pull shorts on and off and also providing for a privacy shield should the fly area become open.

DETAILED DESCRIPTION OF THE INVENTIONS

Figure 1:
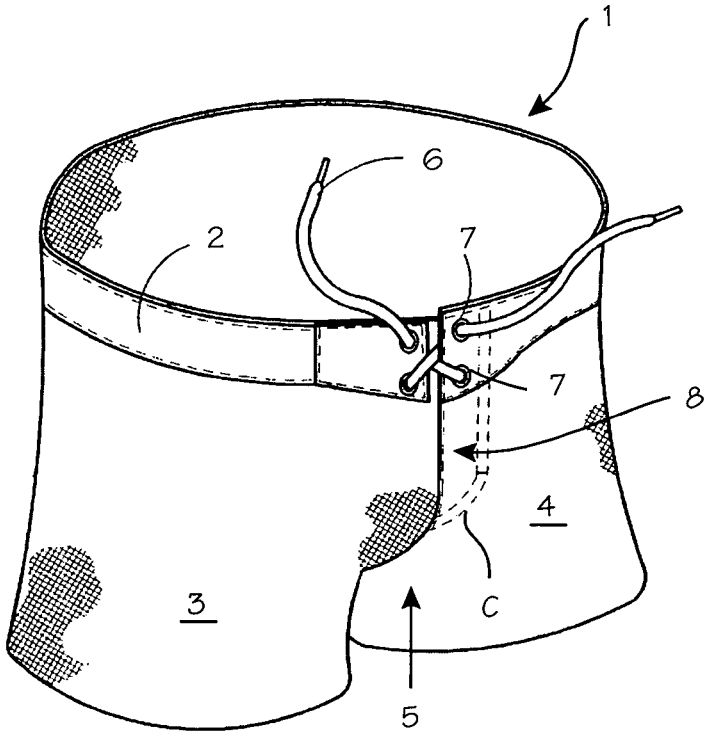
FIG. 1 is a perspective view of a pair of board shorts with the fly closure device of the present invention.

FIG. 1 shows a perspective view of a pair of board shorts 1. The shorts 1 include a waistband 2, a right front panel 3 and a left front panel 4. The left front panel overlaps the right front panel along the center front 5 to provide the appearance of a zippered fly. Top stitching along line C on the left front panel further provides the appearance of a zippered fly. Laces 6 extending through grommets 7 at the waistband close the fly 8. These board shorts 1 are preferably constructed of a quick-dry type fabric, such as nylon, sanded excaliber nylon, dynasuede polyester, or lightweight neoprene.

Figure 2:
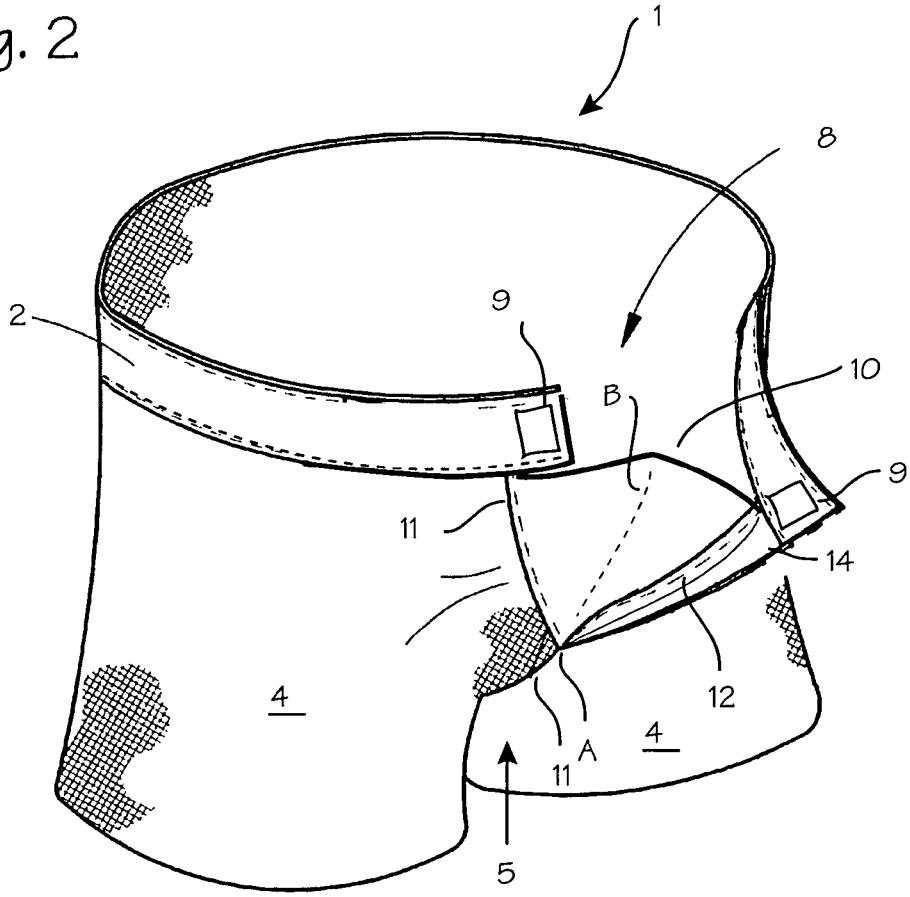
FIG. 2 is a perspective view of a pair of board shorts with the fly closure device of the present invention with the fly open and the gore visible.

FIG. 2 provides a perspective view of the board shorts 1, showing another embodiment in which VELCRO® fasteners 9 are used to close the fly 9 in the waistband 2 area. Various other closure apparatus can be used to close the fly 8 at the waistband 2.

In FIG. 2, the board shorts 1 are shown with the fly 8 pulled open. A gore 10 is provided in the fly 8 and is secured to both the right and left front panels along seams 11 and 12. The gore 10 acts as the primary closure for the fly and as a privacy shield when the fly 8 is pulled wide open. The fly 8 extends from the waistband 2 to a base point A at which the right and left front panels are sewn together. The base point A is preferably positioned along the center front 5.

The right front panel 3 and left front panel 4 are placed right sides together with raw edges even and stitched along the center front seam 11, from pant front inseam (not shown) to base point A. Above base point A, the right front panel is folded under to form a right front fly extension 13 (shown in FIG. 3) and the left front panel is folded under to form a left front fly extension 14. The right front fly extension is placed over the first edge of the gore, with the gore fabric right side up, and top stitched along center front seam 11 above base point A. The second edge of the gore is slid into the left front fly extension 14 and top stitched along seam 12. Alternatively, the gore could be stitched to the right and left front panel by placing the right sides of the gore and the right sides of the right and left front panels and stitching along center front seam 11 and seam 11. Alternatively, the gore 10 could be sewn to the right front panel 3 and the left front panel 4 in any manner achieving the desired result.

Figure 3:
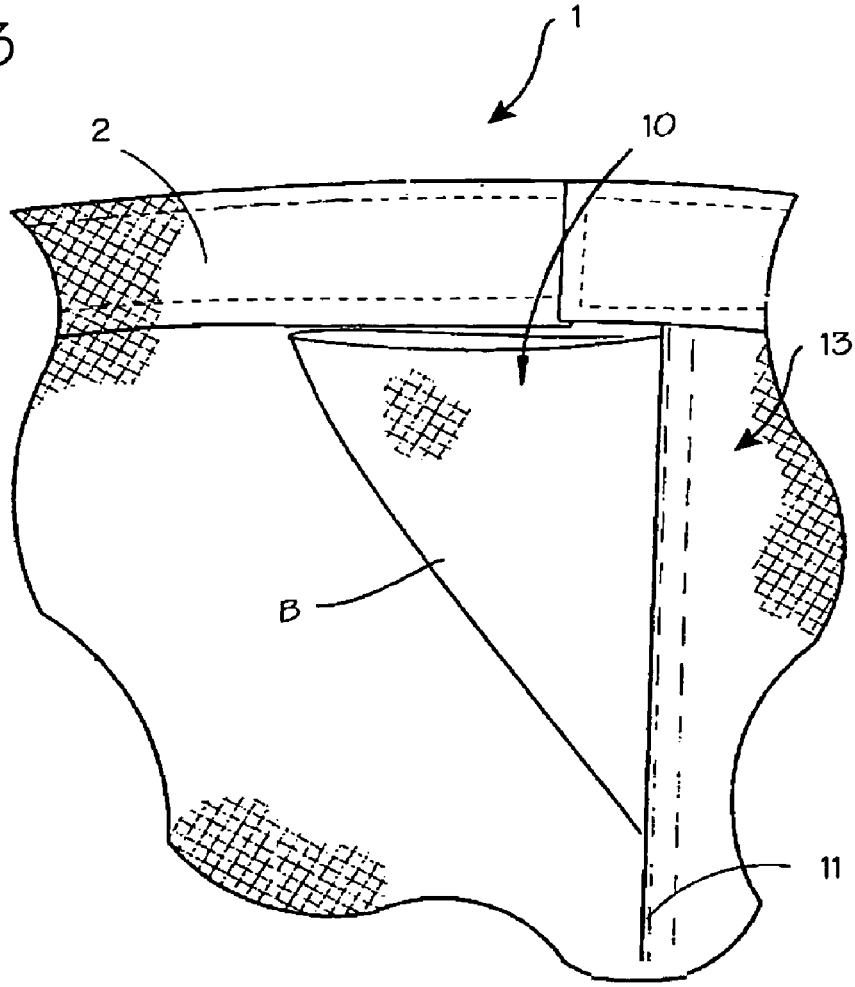
FIG. 3 is a view of the fly area of the board shorts of FIG. 1 from inside the shorts and showing the gore lying flat and in a closed position.

FIG. 3 provides a close up view of the back portion of the fly 8, viewed from within the shorts 1. The gore is shown lying flat in the closed position with the gore 10 folded over onto fold line B.

The gore 10 is a triangular piece of cloth. The gore 10 fabric is preferably a quick dry non-woven fabric which need not be folded over and sewn at the raw edges to provide structural integrity to the raw edge of the fabric. For example, light-weight neoprene is a quick dry non-woven fabric which is durable, stretchy and does not run or otherwise degrade structurally when force is applied upon it. Unlike woven fabric such as LYCRA® or nylon, neoprene does not run when force is exerted upon it and therefore does not require a finishing seam. Other non-woven fabric or polymer sheets would also be suitable, including but not limited to rubber and plastic. Alternatively, a woven fabric that would normally run or fray may be used, so long as the finished edge is pinked or otherwise cut such as to prevent runs from occurring when stress is applied. Additionally, a raw edge could be reinforced with a straight line of stitching without the need to fold over the fabric before stitching.

Referring again to FIG. 2, the gore unfolds and opens so that the wearer can pull the shorts 1 on over her hips. Once on the wearer, the fly 8 may be closed as shown in FIG. 1, wherein the gore folds and lies flat. Any movement of the wearer that would tend to open the middle portion of the fly 8, between the waistband 2 and the base point A, would expose only the gore. Thus, visual access through the fly 8 is prevented and the wearer's privacy is preserved.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A garment comprising:

a right front panel;

a left front panel;

the right front and left front panels being joined together along a portion of their pant front inseam by a seam, leaving a vertical opening above the seam; and a gore attached to the right front panel and the left front panel, wherein the gore comprises a neoprene fabric;

wherein the right front panel and the left front panel are made of a fabric that is different than the neoprene fabric of the gore.

2. The garment of claim 1 further comprising a waistband extending from the right front and left front panels, the waistband including a fastener adapted to releasably hold the right front and left front panels in close proximity to one another.

3. Short pants having a vertical slit opening in a fly area and left and right front panels, the shorts further comprising:

a triangular gore having an upper edge, a lower apex, and left and right edges, the gore secured at its left edge to the right front panel and secured at its right edge to the left front panel, the gore comprised of a neoprene fabric;

wherein the left and right panel are made of a fabric that is different than the neoprene fabric of the triangular gore.

4. The short pants of claim 3 further comprising a waistband extending from the right front and left front panels, the waistband including a fastener adapted to releasably hold the right front and left front panels in close proximity to one another.

5. Short pants comprising:

a waistband;

left and right panels attached to the waistband and to one another at a base portion;

a fly opening beginning at the base portion and extending upward between the left and right panels to the waistband; and a triangular fly piece made of a neoperene fabric and attached to the base portion, the left and right panels, and the waistband to close the fly opening;

wherein the left and right are made of a fabric that is different than the neoprene fabric of the triangular fly piece.

6. The short pants of claim 5 wherein the waistband comprising a fastener adapted to releasably hold the left and right panels in close proximity to one another.

7. The garment of claim 1 wherein the fabric is a quick-dry fabric.

8. The short pants of claim 3 wherein the fabric is a quick-dry fabric.

9. The short pants of claim 5 wherein the fabric is a quick-dry fabric.

10. The garment of claim 1 wherein the fabric is selected from a group consisting of nylon, sanded excaliber nylon, and dynasuede polyester.

11. The short pants of claim 3 wherein the fabric is selected from a group consisted of nylon, sanded excaliber nylon, and dynasuede polyester.

12. The short pants of claim 5 wherein the fabric is selected from a group consisting of nylon, sanded excaliber nylon, and dynasuede polyester.

* * * * *